US005400005A

United States Patent [19]

Bobry

[11] Patent Number: 5,400,005

[45] Date of Patent: Mar. 21, 1995

[54] TOROIDAL TRANSFORMER WITH MAGNETIC SHUNT

[75] Inventor: Howard H. Bobry, Edmonds, Wash.

[73] Assignee: Albar, Incorporated, Lynnwood, Wash.

[21] Appl. No.: 34,310

[22] Filed: Mar. 22, 1993

Related U.S. Application Data

[62] Division of Ser. No. 819,866, Jan. 13, 1992, abandoned.

[51] Int. Cl.[6] ..... H01F 27/30

[52] U.S. Cl. ..... 336/83; 336/120; 336/165; 336/178; 336/212

[58] Field of Search ..... 336/83, 213, 234, 233, 336/229, 178, 73, 120, 165, 212, 221

[56] References Cited

U.S. PATENT DOCUMENTS

| | | | |
|---|---|---|---|
| 352,105 | 11/1886 | Zipernowsky et al. | 336/83 |
| 375,614 | 12/1887 | Bickemeyer | 336/83 |
| 414,266 | 11/1889 | Thomson | 336/83 |
| 3,304,599 | 2/1967 | Nordin | 336/83 |

FOREIGN PATENT DOCUMENTS

| | | | |
|---|---|---|---|
| 762789 | 4/1934 | France | 336/83 |
| 5201 | of 1885 | United Kingdom | 336/213 |
| 260731 | 11/1926 | United Kingdom | 336/83 |

*Primary Examiner*—Thomas J. Kozma
*Attorney, Agent, or Firm*—Rankin, Hill, Lewis & Clark

[57] ABSTRACT

A transformer or inductor is made by wrapping a magnetic core material about a toroid-like structure made up of one or more electrical windings. A ferroresonant transformer may be constructed by including a slotted washer between primary and secondary windings. By shorting one of the windings, the ferroresonant transformer can be made into a gapped inductor with the gap totally enclosed within the core.

3 Claims, 3 Drawing Sheets

Fig. 1
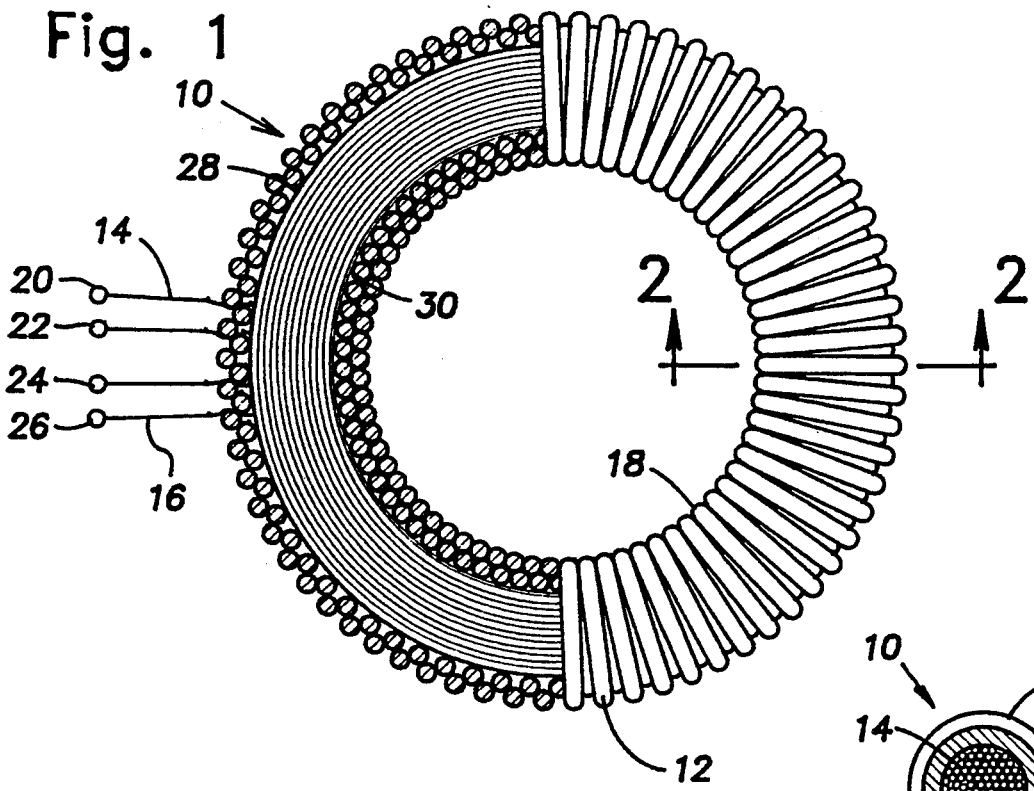
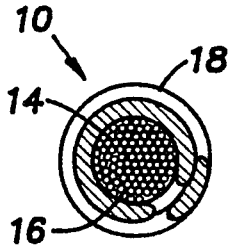
Fig. 2
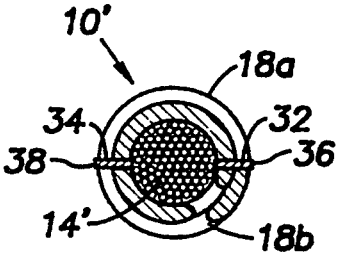
Fig. 3
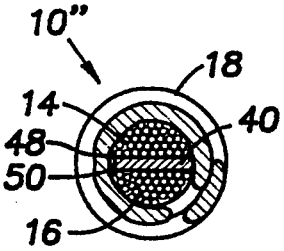
Fig. 4
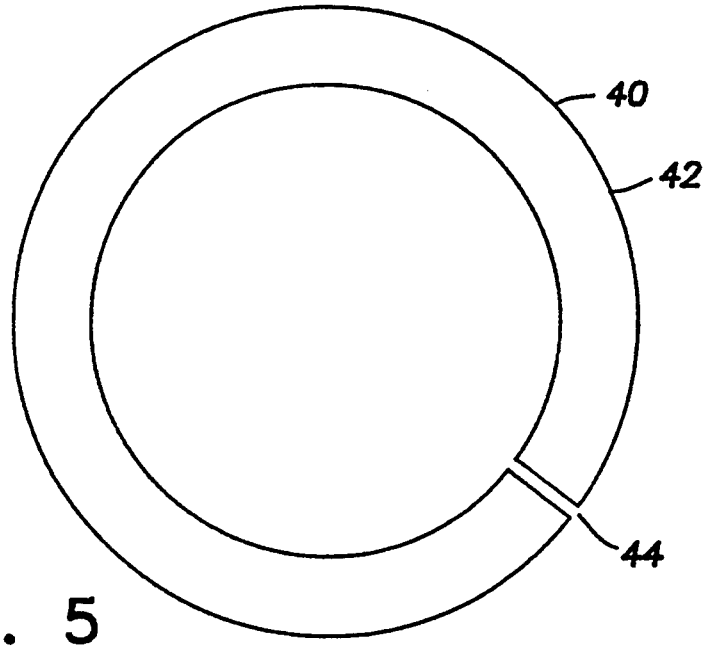
Fig. 5

Fig. 6
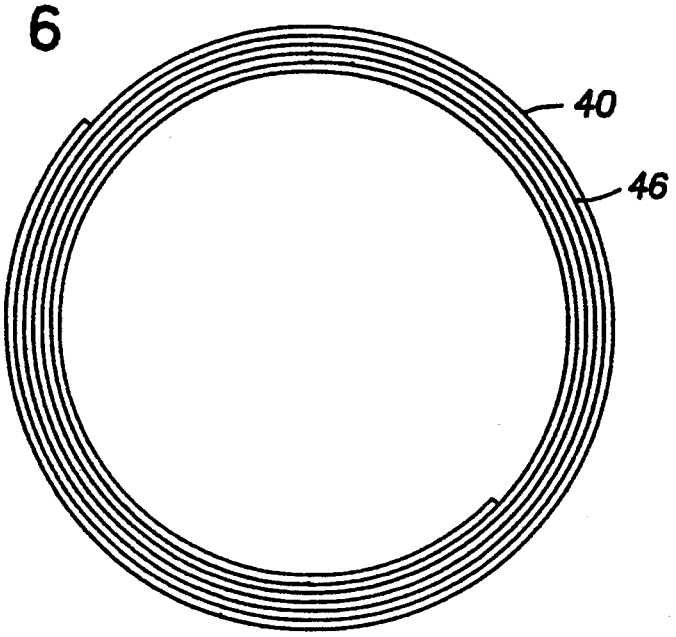
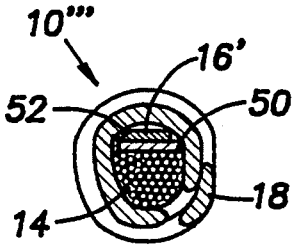
Fig. 7
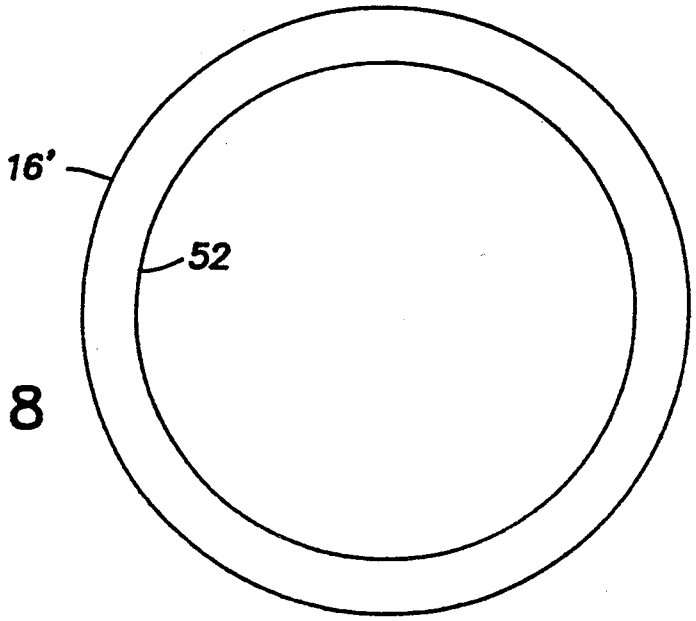
Fig. 8
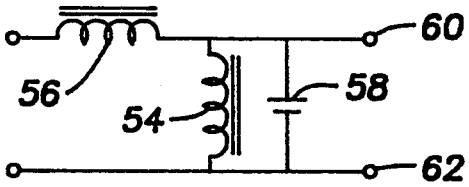
Fig. 9 (prior art)

Fig. 10
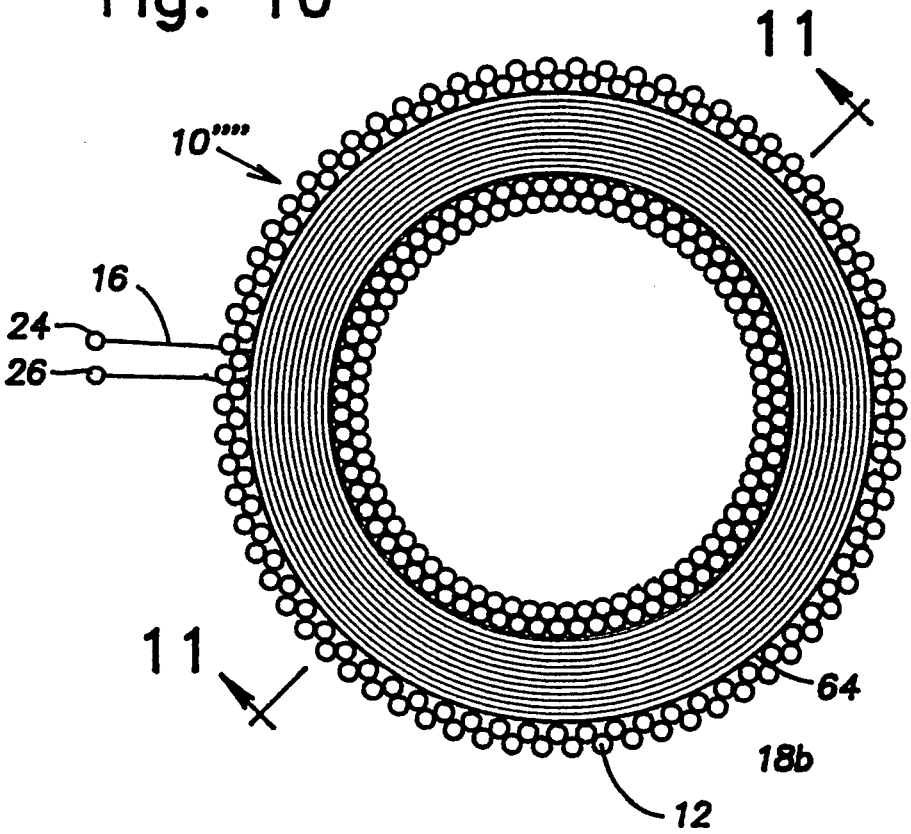
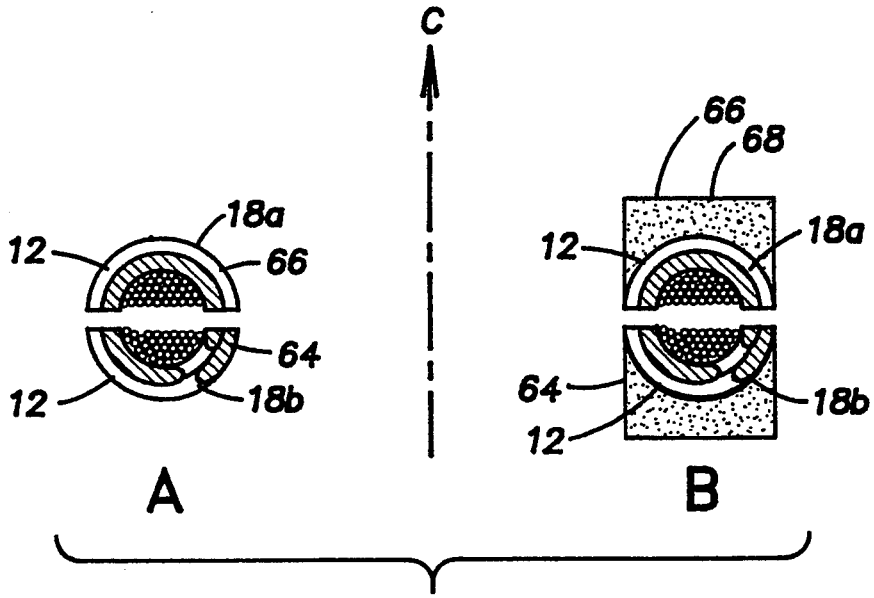
Fig. 11

TOROIDAL TRANSFORMER WITH MAGNETIC SHUNT

This is a division of application Ser. No. 07/819,866, now abandoned, filed Jan. 13, 1992.

BACKGROUND OF THE INVENTION

This invention relates to transformers and methods for making transformers and in particular to transformers with wound cores.

It is well-known to construct transformers and inductors by winding electrical wire around a toroidal magnetic core. The wire is wound around the surface of the toroid by passing the end of the wire repeatedly through the central opening of the toroid.

It is also well-known to form so-called pot core transformers in which coiled windings are placed within an enclosing hollow toroid-like shell formed of metal powder or ferrite.

U.S. Pat. No. 2,972,724 shows a different approach to transformer construction in which an electric coil is provided with magnetic cores formed by winding successive short interlocking strips of magnetic material around portions of the coil.

U.S. Pat. No. 4,958,134 shows an inductor formed by winding a ribbon of magnetic material around a single U.S. Pat. No. 4,958,134 shows an inductor formed straight length of conductor.

U.S. Pat. No. 4,754,180 shows transformers in which the primary and secondary have no physical connection, thus allowing movement between the two.

SUMMARY OF THE INVENTION

The present invention has electrical windings in a generally toroidal shape and the magnetic core is formed by winding a magnetic material around the surface of the toroid by passing the end of the material repeatedly through the central opening of the toroid.

The core is wound to the desired thickness resulting in the electrical windings being fully encased in the metal core. This results in a rugged and inherently shielded structure.

The invention is an inductor or transformer including at least one electrical winding forming a toroid-like structure having a surface and a central opening and a magnetic core formed from a continuous length of material wound around the surface through the opening. The length of material may advantageously have a substantially circular cross section.

A ferroresonant transformer is disclosed that includes a primary winding, a secondary winding, a generally planar magnetic shunt having a central opening, an inner edge about the opening and an opposite outer edge. The shunt is sandwiched between the windings to form together a toroid-like structure having a surface and a central passage. A magnetic core is formed from a continuous length of material wound around the surface through the passage. At least one of the inner and outer edges is spaced away from the core. The magnetic shunt may be a slotted washer or a coil of insulated magnetic wire.

A gapped-core inductor or transformer may be made by providing a toroid-like form having a surface and a central opening, wrapping a continuous length of magnetic material around the surface through the opening, bonding or encapsulating the magnetic material to form an integral structure, radially sectioning the structure into two hollow shells, and placing at least one winding within the shells and a spacer between the shells.

A gapped-core inductor or transformer may also be made by providing at least one electrical winding forming a toroid-like structure having a surface and a central opening, wrapping a continuous length of magnetic material around the surface through the opening, bonding or encapsulating the magnetic material to form an integral shell having a wall, and cutting a continuous slot in the wall parallel to the at least one winding.

An inductor is disclosed including a primary winding, a short-circuited secondary winding, a generally planar magnetic shunt having a central opening, an inner edge about the opening and an opposite outer edge. The shunt is sandwiched between the windings to form together a toroid-like structure having a surface and a central passage. A magnetic core is formed from a continuous length of material wound around the surface through the passage. At least one of the inner and outer edges is spaced away from the core. The short-circuited secondary winding may be an electrically conductive washer.

A rotary transformer is disclosed that includes a first magnetic core section having the shape of a radially-sectioned portion of a hollow toroid-like structure and a second magnetic core section having the shape of a radially-sectioned portion of a hollow toroid-like structure. A primary winding is disposed within the hollow of the first core section and a secondary winding is disposed within the hollow of the second core section. The first and second core sections are positioned to jointly form a substantially closed hollow toroid-like structure and the first core section and primary winding being able to axially rotate with respect to the second core section and secondary winding.

In the preferred embodiment, the core sections are formed by providing a toroid-like form having a surface and a central opening, wrapping a continuous length of magnetic material around the surface through the opening, bonding or encapsulating the magnetic material to form an integral structure, and radially sectioning the integral structure into the first and second magnetic core sections.

BRIEF DESCRIPTION OF THE DRAWINGS

FIG. 1 is a plan view of a transformer according to the invention with portions cut away.

FIG. 2 is a cross sectional view along the line 2—2 of FIG. 1.

FIG. 3 is a cross sectional view in elevation of a portion of a gapped-inductor according to the invention.

FIG. 4 is a cross sectional view in elevation of a portion of a ferroresonant transformer according to the invention.

FIG. 5 is a plan view of a shunt according to the invention.

FIG. 6 is a plan view of another shunt according to the invention.

FIG. 7 is a cross sectional view in elevation of a portion of another embodiment of a gapped-inductor according to the invention.

FIG. 8 is a plan view of a shorted winding according to the invention.

FIG. 9 is a schematic circuit diagram of an equivalent circuit of a ferroresonant transformer.

FIG. 10 is a plan view of a rotating transformer according to the invention with the primary portion cut away.

FIG. 11 is a cross sectional view in elevation taken along line 11—11 of FIG. 10 with the primary portion included and also showing alternative embodiments.

DESCRIPTION OF THE PREFERRED EMBODIMENTS

Referring to FIGS. 1 and 2, a transformer 10 is formed by winding a length of magnetic material 12 around a primary winding 14 and a secondary winding 16. The wound magnetic material 12 forms the core 18 of the transformer 10.

The primary winding 14 has terminals 20, 22 and the secondary winding 16 has terminals 24, 26.

The windings 14, 16 may be, for example, co-cylindrically adjacent with one another, in concentric relationship with one another, or even interwound. Together, the windings 14, 16 form a toroid-like structure 28 having a central opening 30 through which the magnetic material 12 is wound.

The windings 14, 16 may be, for example, each formed of coils of copper wire having an electrically insulating covering such as enamel.

The magnetic material 12 may be, for example, a strip of iron, steel or nickel. Also, various alloys are known in the transformer art to be useful for core construction.

Some core materials may need to be annealed after winding. If done conventionally, this could melt the electrical windings. As an alternative, energy from a laser could be used to locally anneal the magnetic material 12 as it is wound. This would avoid damaging the electrical windings.

The magnetic material 12 may be in the form of a tape-like strip. However, this flat tape may not conform to the round circumference of the opening 30.

In the preferred embodiment, the magnetic material 12 is in the form of a continuous length of circular cross section wire. The radius of the wire is advantageously chosen to be small with respect to that of the central opening 30, thereby allowing magnetic material 12 to efficiently fill the opening 30 to a desired core cross section. The material 12 is covered with an insulating material, for example, enamel. This insulating material minimizes eddy currents in the core 18.

It should be noted that the core 18 is thicker towards the opening 30 than around the outer circumference of the structure 28. However, the actual cross sectional area of the core 18 is constant because the circumference of the opening 30 is corresponding smaller than the outer circumference of the structure 28. This constant area then provides constant flux density.

Referring to FIG. 3, a gapped-core inductor 10′ is essentially the transformer 10 with only a single winding 14′ and the core 18 cut into two halves 18*a*, 18*b*. Gaps 32, 34 are maintained between the halves 18*a*, 18*b* by spacers 36, 38, respectively.

The spacers 36, 38 may be, for example, paper washers between the halves 18*a*, 18*b*.

The halves 18*a*, 18*b* may be, for example, formed by winding the core 18 around a dummy coil or form similar to the toroid-like structure 28 and then radially sectioning the resulting toroid-like structure by cutting it in half and removing the form leaving two hollow shells. The integrity of the core halves 18*a*, 18*b* can be maintained by bonding or encapsulating the magnetic material 12 with, for example, epoxy prior to cutting (see FIG. 11 and the description thereof below).

The winding 14′ is then placed in the hollow of the two halves 18*a*, 18*b* with the spacers 36, 38 between the halves 18*a*, 18*b*.

Alternatively, the core 18 can be wound around the winding 14′ and a single gap carefully cut in the core 18 without damaging the winding 14′.

Referring to FIG. 4, a ferroresonant transformer 10″ is formed by inserting a shunt 40 between the windings 14, 16 prior to winding the core 18.

Using a circular cross section magnetic material 12 provides an additional advantage where shunts are used. The magnetic flux must travel from the core 18 to the shunt 40 and vice versa. In the case of a core formed from a tape-like strip, the flux must pass through the face, or flat surface, of the strip. The flux through the flat surface causes increased losses due to eddy currents in the material. The circular cross section magnetic material 12 has no such flat surfaces, so eddy currents are minimized.

The shunt 40 may be, for example, in the form of a slotted-washer 42 of magnetic material as shown in FIG. 5. The slot 44 prevents an induced current from circulating in the shunt 40 (i.e. a short-circuit).

Alternatively, the shunt 40 may be, for example, formed of a coil of insulated magnetic wire 46 as shown in FIG. 6.

The transformer 10″ has a gap 48 between at least one edge of the shunt 40 and the core 18.

The size of the gap 48 can be closely controlled by making the shunt 40 slightly wider in the radial direction than the windings 14, 16 so that the only space between the core 18 and the shunt 40 results from a spacer 50. The spacer 50 can be placed on the edge of the shunt 40 prior to winding the core 18. The spacer 50 may be, for example, a circular band of paper.

Referring to FIG. 7, an alternate construction of a gapped-core inductor 10‴ is formed by replacing the winding 16 of FIG. 4 with a short-circuited winding 16′. While this could be accomplished by simply connecting the terminals 24, 26 of the winding 16, it is less expensive and easier to just replace the winding 16 with a washer 52 (see FIG. 8) made of an electrical conductor such as copper with an insulating coating prior to winding the core 18.

Referring to FIG. 9, a schematic circuit diagram of an equivalent circuit of a ferroresonant transformer is shown. It consists of a saturating core 54 and a shunt inductance 56. Normally, a capacitor 58 is placed across the saturating core 54 and the output of the transformer is at the terminals 60, 62. However, when the terminals 60, 62 are shorted together, the saturating core 54 (and the capacitor 58) is effectively eliminated and only the shunt inductance 56 remains.

Thus, it can be seen that by providing a short-circuited winding 16′ the transformer 10″ of FIG. 4 becomes the gapped-core inductor 16‴ in FIG. 7.

As a further alternative, the short-circuited winding 16′ can simply be the magnetic shunt 40 in the form of an un-slotted conductive washer of a magnetic material. The un-slotted washer then acts as both a magnetic shunt and a shorted winding.

The transformer of FIG. 1 can be further modified to provide a rotary transformer suitable for transmitting power across a rotating joint without slip rings or brushes. Referring to FIGS. 10 and 11, a rotating transformer 10⁗ is formed by dividing the transformer of FIG. 1 in half radially into: a primary portion 64 and a secondary portion 66. In this case, the windings 14, 16 are co-cylindrically adjacent so that the primary winding 14 can be in one half 18*a* of the core 18 and the secondary winding 16 can be in the other half 18*b* of the core 18.

As described above, the core 18 may be advantageously wound on a dummy form. Referring to FIG. 11, the magnetic material 12 forming the core 18 may be simply bonded together, for example, by epoxy as in the section indicated by the letter A. Alternatively, the magnetic material 12 may be encapsulated in a material 68 (e.g. epoxy) as in the section indicated by the letter B.

The windings 14, 16 are mounted in the core halves 18*a*, 18*b*, respectively. They may be, for example, held in place with epoxy.

In operation, the primary portion 64 is mounted coaxially adjacent to the secondary portion 66 such that the two portions 64, 66, as closely as practical, recreate the original toroid-like structure of the core 18. In addition, the portions 64, 66 are mounted to permit them to rotate with respect to each other about the axis C of the transformer 10''''.

The simplest such arrangement would be to mount the portions 64, 66 on opposite sides of two parallel non-magnetic plates joined by a rotating joint located at the axis C.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A ferroresonant transformer comprising:

a primary winding;

a secondary winding;

a generally planar magnetic shunt, having a central opening, an inner edge about said opening and an opposite outer edge, said shunt being sandwiched between said windings to form together a toroid-like structure having a surface and a central passage;

a magnetic core formed from a continuous length of material wound around said surface through said passage, at least one of said inner and outer edges being spaced away from said core.

2. A ferroresonant transformer according to claim 1, wherein said magnetic shunt is a slotted washer.

3. A ferroresonant transformer according to claim 1, wherein said magnetic shunt is a coil of insulated magnetic wire.

* * * * *